US007708242B1

(12) United States Patent
Petrashune et al.

(10) Patent No.: US 7,708,242 B1
(45) Date of Patent: May 4, 2010

(54) BUCKET HOLDING APPARATUS AND ASSOCIATED METHOD

(76) Inventors: Chris Petrashune, 34168 Shockleytown Rd., Frankford, DE (US) 19445; Michael Cordeaux, 33 S. Williams St., Selbyville, DE (US) 19975; Brian Warner, 33547 Beaver Damn Rd., Frankford, DE (US) 11945

( * ) Notice: Subject to any disclaimer, the term of this patent is extended or adjusted under 35 U.S.C. 154(b) by 444 days.

(21) Appl. No.: 11/900,093

(22) Filed: Sep. 10, 2007

Related U.S. Application Data

(60) Provisional application No. 60/824,911, filed on Sep. 8, 2006.

(51) Int. Cl.
*A47G 23/02* (2006.01)

(52) U.S. Cl. ..... 248/150; 248/154; 248/346.5; 248/500; 220/737; 220/630

(58) Field of Classification Search ..... 248/346.5, 248/346.03, 346.01, 907, 150, 154, 500; 220/737, 625, 636, 742, 571, 571.1, 628, 220/630; 366/349, 129; D32/54, 53, 53.1
See application file for complete search history.

(56) References Cited

U.S. PATENT DOCUMENTS

| | | | | |
|---|---|---|---|---|
| 1,954,692 | A * | 4/1934 | Burns | 81/3.32 |
| 4,877,208 | A | 10/1989 | Kennard, Jr. | |
| 6,361,001 | B1 | 3/2002 | Duranad | |
| 6,464,184 | B1 * | 10/2002 | Lytle | 248/126 |
| 7,258,312 | B2 * | 8/2007 | Grosse | 248/154 |

* cited by examiner

*Primary Examiner*—A. Joseph Wujciak, III

(57) ABSTRACT

A bucket holding apparatus includes first and second carriages with pivotally attached inner edges arranged in such a manner that the first and second carriages freely rotate upwardly from a horizontal plane defined on a support surface. The bucket holding apparatus further includes first and second arcuate walls directly conjoined to the first and second carriages and oppositely situated from the inner edges such that the first and second arcuate walls define a circular cavity within a combined perimeter thereof. The bucket holding apparatus further includes an arcuate lever directly and statically conjoined to the second carriage and extending laterally upwards away from an outer edge thereof.

18 Claims, 5 Drawing Sheets

BUCKET HOLDING APPARATUS AND ASSOCIATED METHOD

CROSS REFERENCE TO RELATED APPLICATIONS

This application claims the benefit of U.S. Provisional Application No. 60/824,911, filed Sep. 8, 2006, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to bucket holders and, more particularly, to a bucket holding apparatus for holding a bucket at a stationary position during operating procedures.

2. Prior Art

For do-it-yourselfers and tradesmen, the development and introduction of power tools made the accomplishment of many jobs much easier and less physically demanding. Starting with the introduction of the power-driven screwdriver in 1987 and then the arrival of 18 and 24 volt cordless drills, battery-powered electric tools have gained wide acceptability among both do-it-yourselfers and contractors. Battery charging times, which initially were measured in hours, have been compressed to minutes.

Cordless tools have proved immensely popular on outdoor job sites and in areas, including many foreign markets, where electric power supplies are unreliable. According to newly released U.S. Census of Manufactures data, product shipments of battery-powered tools have more than doubled in the last ten years. However, one job which must be performed fairly often by do-it-yourselfers and many tradesmen which has not been made any easier by the use of power tool is the basic job of mixing various types of substances such as caulks, compounds, paints, drywall mud, and other materials.

This job is normally accomplished by pouring a substance in a bucket and holding the bucket with the legs and knees while the substance is being stirred to form a homogenous mixture. Even if an electric drill is used, this is still a time consuming and labor intensive task which frequently results in a fair amount of spillage. Obviously, it would be advantageous to provide a means for eliminating or alleviating the problems of spillage and physical effort required to mix various types of substances within a bucket.

U.S. Pat. No. 4,877,208 to Kennard discloses a support for a mixer bucket which includes a raised platform having a recess shaped to accommodate a mixer bucket. Resistance means are provided in the recess that engages against the bucket to maintain the bucket stationary while the contents of the bucket are being mixed. Unfortunately, this prior art example can not be used on all horizontal surfaces.

U.S. Pat. No. 6,361,001 to Durand discloses a container holder for mixing slurry material in a 2½ or 5 gallon bucket. The container holder is formed from a one-piece raised top portion having a centrally disposed aperture allowing insertion of a stirring paddle. Depending from the top portion are two legs that extend downwardly and span the entire height of the bucket to be mixed with foot pads joined at the bottom of the legs extending outwardly therefrom which allow an individual to stand on during the mixing operation. Unfortunately, this prior art example is not designed to be easily moved or stored.

U.S. Pat. No. 6,464,184 to Lytle discloses an apparatus for retaining a canister having an adjustable base and at least one swing member attached to the base and preferably two swing members attached to the base opposite each other. The base further has a spring member disposed thereupon and in contact with the swing member to keep the swing member in a first open position. The swing member has a first end that is rotatably attached to the base via a hinge member and a second end that has a semicircular recess formed therein. The base is adjustable to provide an adjustable range of motion of the swing member with respect to the base. In operation, the apparatus moves from a first open position to a second closed position upon application of a force upon the swing members to retain a canister placed between the swing members. Use of the apparatus results in no temporary movement or constricting of a worker's limbs that may result in imbalance or injury, nor requires a second person to stabilize the canister. Unfortunately, this prior art example is not designed to be easily moved or stored.

Accordingly, the present invention is disclosed in order to overcome the above noted shortcomings. The present invention satisfies such a need by providing an apparatus that is convenient and easy to use, lightweight yet durable in design, and designed for holding a bucket at a stationary position during operating procedures. The bucket holding apparatus is comprised of two interconnected sections that are placed on any horizontal surface for use. The apparatus advantageously allows the user to quickly and easily mix materials within a bucket without running the risk of knocking the container over, and spilling the contents thereof. This saves the user a considerable amount of time, energy, and also money that would otherwise be lost to wasted product as the result of a spill. The present invention is simple to use, inexpensive, and designed for many years of repeated use.

BRIEF SUMMARY OF THE INVENTION

In view of the foregoing background, it is therefore an object of the present invention to provide an apparatus for holding a bucket at a stationary position during operating procedures. These and other objects, features, and advantages of the invention are provided by a bucket holding apparatus.

A bucket holding apparatus includes first and second carriages with pivotally attached inner edges arranged in such a manner that the first and second carriages freely rotate upwardly from a horizontal plane defined on a support surface. Each of such first and second carriages effectively articulates about a shared fulcrum axis confronting the inner edges, and each of the first and second carriages include a rubber mat directly conjoined to respective top surfaces thereof. Such rubber mats cover a major surface area of the first and second carriage top surfaces and terminate laterally from the first and second walls respectively.

The first carriage pivots along a counter clockwise path and the second carriage pivots along a clockwise path when the lever is biased towards the support surface. The first carriage is conveniently pivotal along a 180 degree arcuate path while the second carriage remains statically positioned on the support surface such that respective bottom surfaces of the first and second carriages lay coplanar and directly abut each other.

The bucket holding apparatus further includes first and second arcuate walls directly conjoined to the first and second carriages and oppositely situated from the inner edges such that the first and second arcuate walls define a circular cavity within a combined perimeter thereof. Each of such walls advantageously include a rubber mat directly conjoined to an inner surface thereof and travel along a major surface area of the inner surfaces for providing a frictional surface against which the bucket is engaged. The first wall is vertically aligned beneath the second wall when the first and second carriages are coplanar.

The bucket holding apparatus further includes an arcuate lever directly and statically conjoined to the second carriage and extending laterally upwards away from an outer edge thereof. The first and second carriages are effectively pivoted about the fulcrum axis when the lever is biased downwardly towards the support surface such that the first and second walls extend apart from a horizontal equilibrium position and thereby increase a diameter of the cavity for receiving the bucket therein.

A method for holding a bucket at a stationary position during operating procedures includes the steps of: pivotally attaching inner edges of first and second carriages together such that the first and second carriages freely rotate upwardly from a horizontal plane defined on a support surface when each of the first and second carriages are articulated about a shared fulcrum axis confronting the inner edges; conjoining first and second arcuate walls directly conjoined to the first and second carriages by oppositely situating the first and second arcuate walls from the inner edges such that the first and second arcuate walls define a circular cavity within a combined perimeter thereof; providing an arcuate lever directly and statically conjoined to the second carriage and extending laterally upwards away from an outer edge thereof; and pivoting the first and second carriages about the fulcrum axis by biasing the lever is biased downwardly towards the support surface such that the first and second walls extend apart from a horizontal equilibrium position and thereby increase a diameter of the cavity for receiving the bucket therein.

The method further includes the steps of: directly conjoining a rubber mater to respective top surfaces of each of the first and second carriages such that the rubber mats cover a major surface area of the first and second carriage top surfaces and terminate laterally from the first and second walls respectively; pivoting the first carriage along a counter clockwise path; and simultaneously pivoting the second carriage along clockwise path by biasing the lever towards the support surface.

The method further including the steps of: directly conjoining a rubber mat to an inner surface of each of the walls such that the rubber mats travel along a major surface area of the inner surfaces for providing a frictional surface against which the bucket is engaged; pivoting the first carriage along a 180 degree arcuate path while the second carriage remains statically positioned on the support surface such that respective bottom surfaces of the first and second carriages lay coplanar and directly abut each other; and vertically aligning the first wall beneath the second wall by adapting the first and second carriages to a coplanar position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
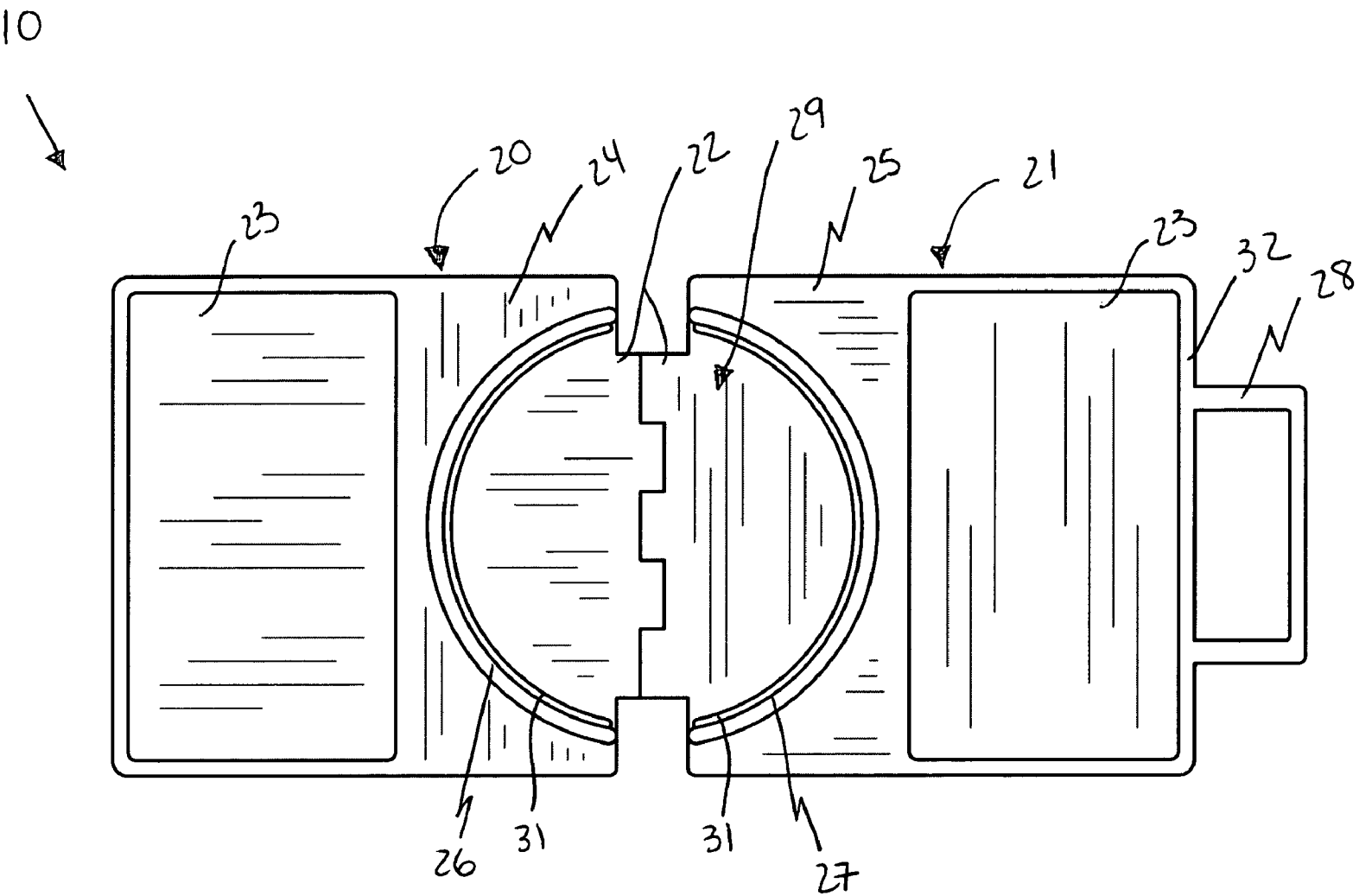
FIG. 1 is a top planar view of a bucket holding apparatus, in accordance with the present invention.
Figure 2:
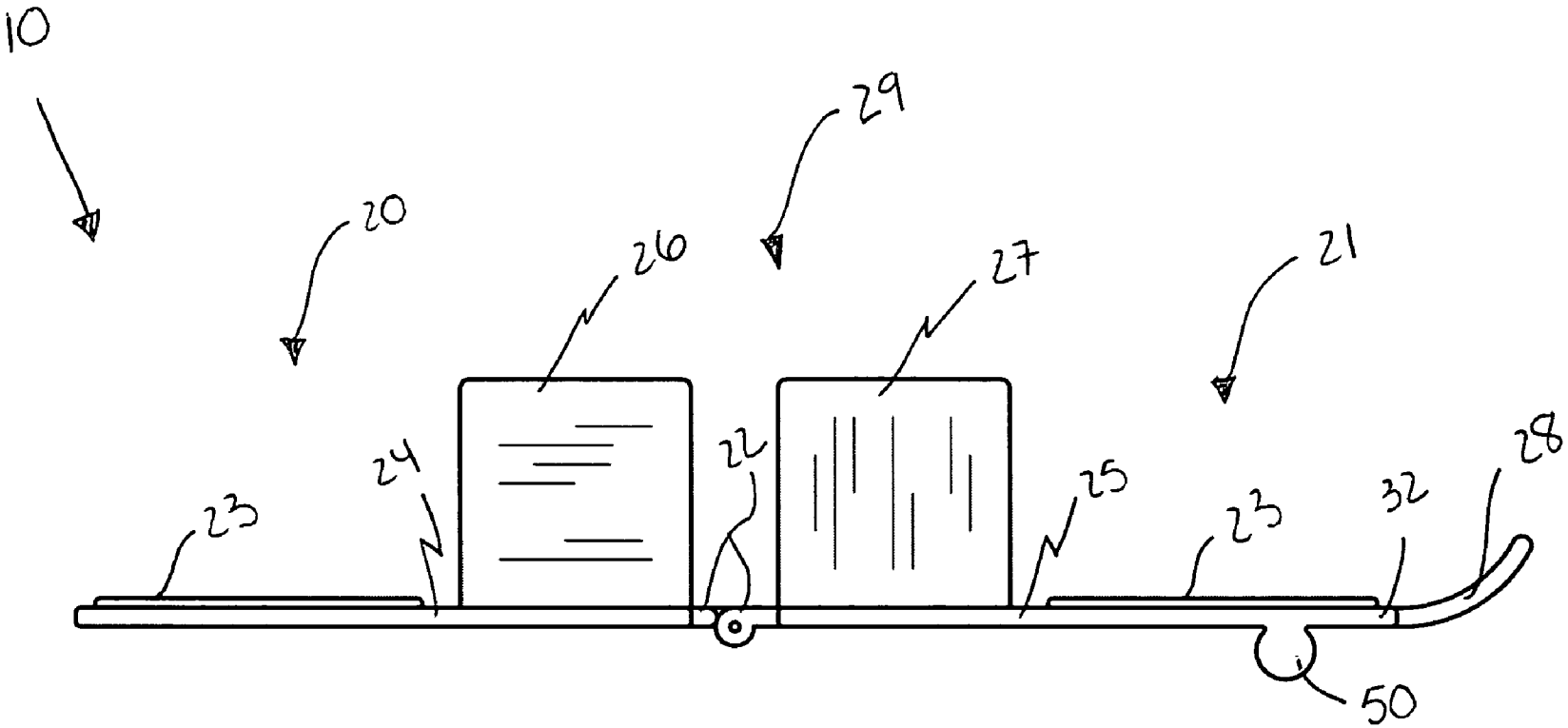
FIG. 2 is a side elevational view of a bucket holding apparatus, in accordance with the present invention.
Figure 3:
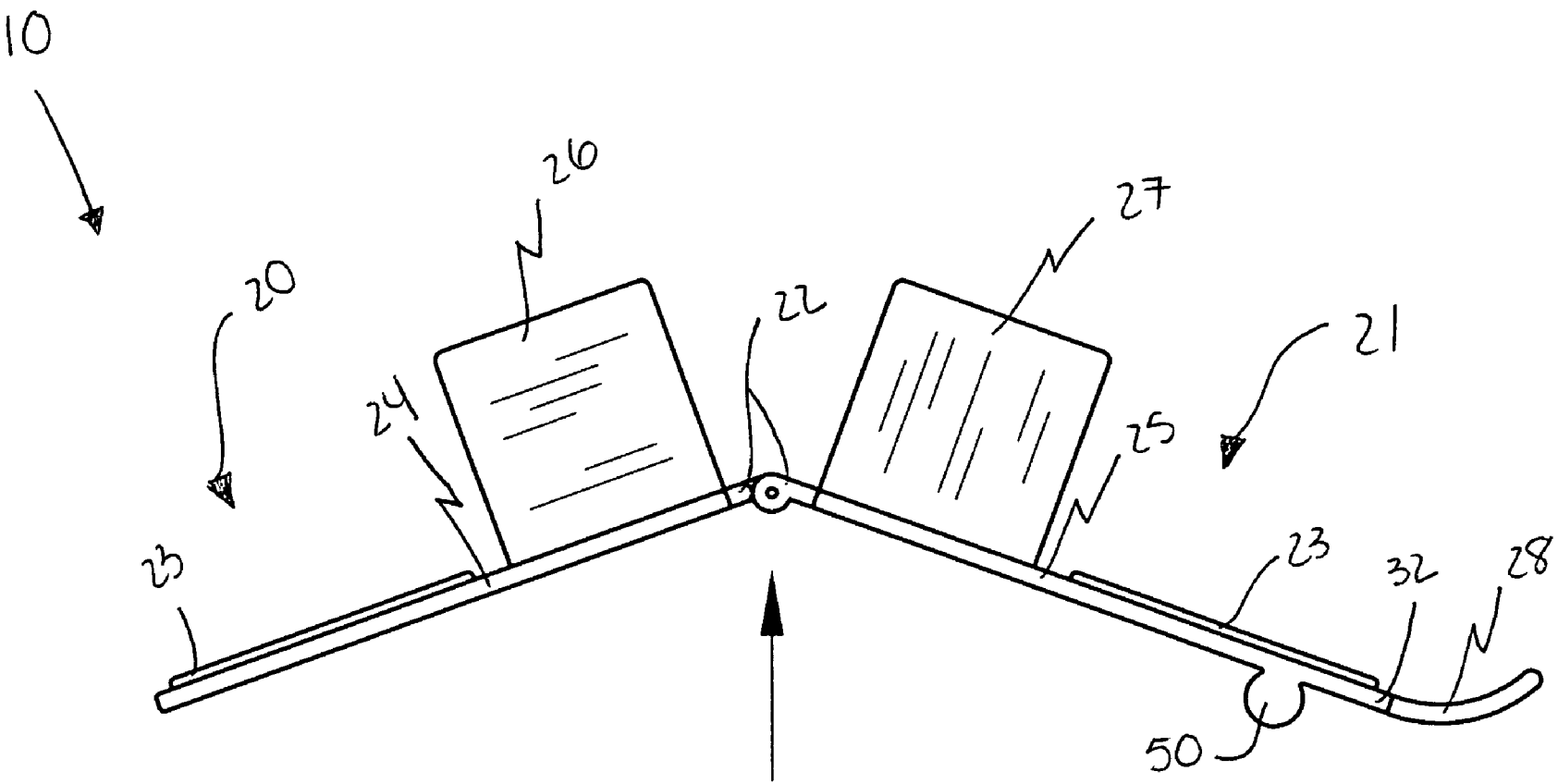
FIG. 3 is a side elevational view of a bucket holding apparatus, showing the pivotal motions of the inner edges, in accordance with the present invention.
Figure 4:
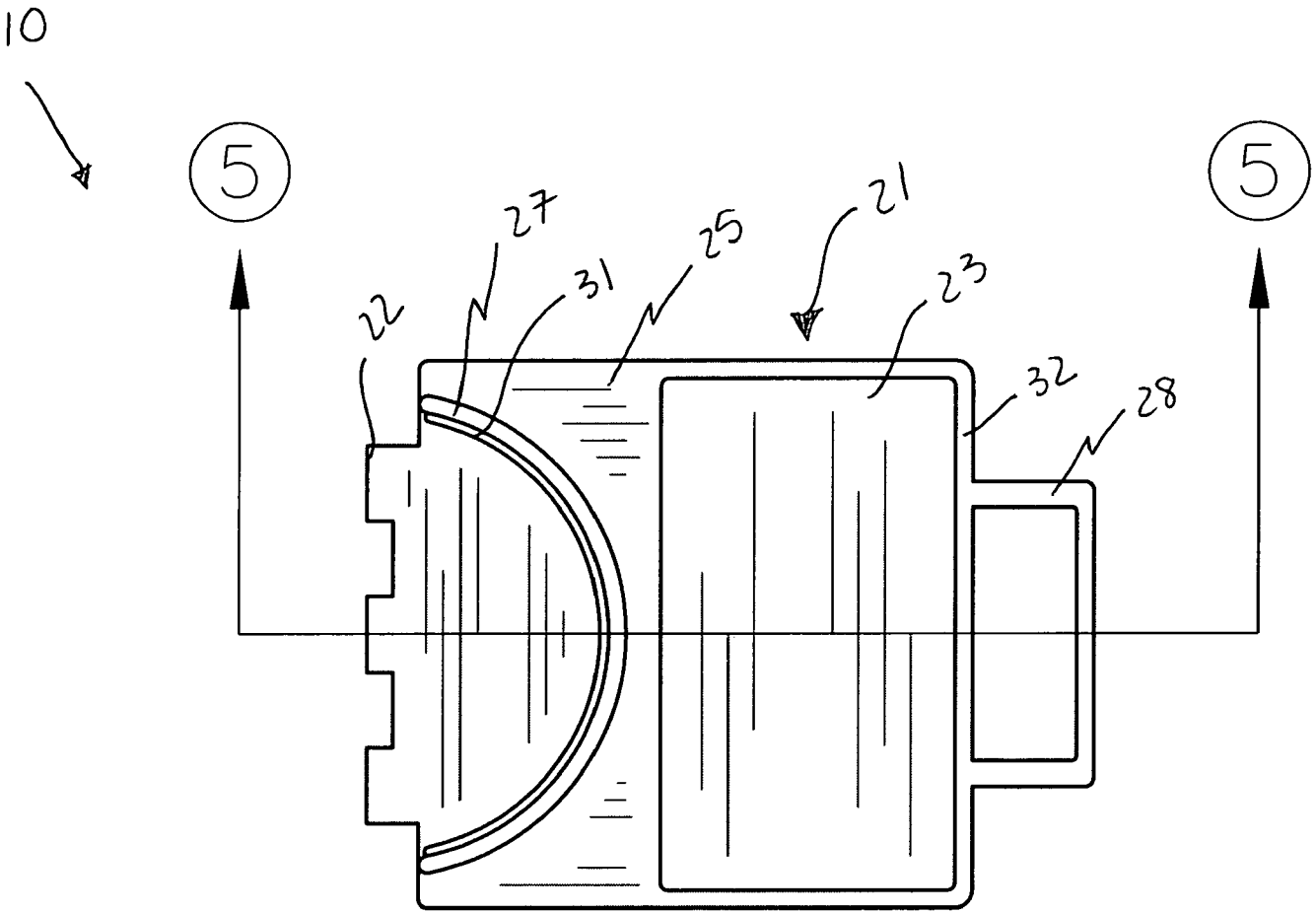
FIG. 4 is a top planar view of the second carriage, in accordance with the present invention.
Figure 5:
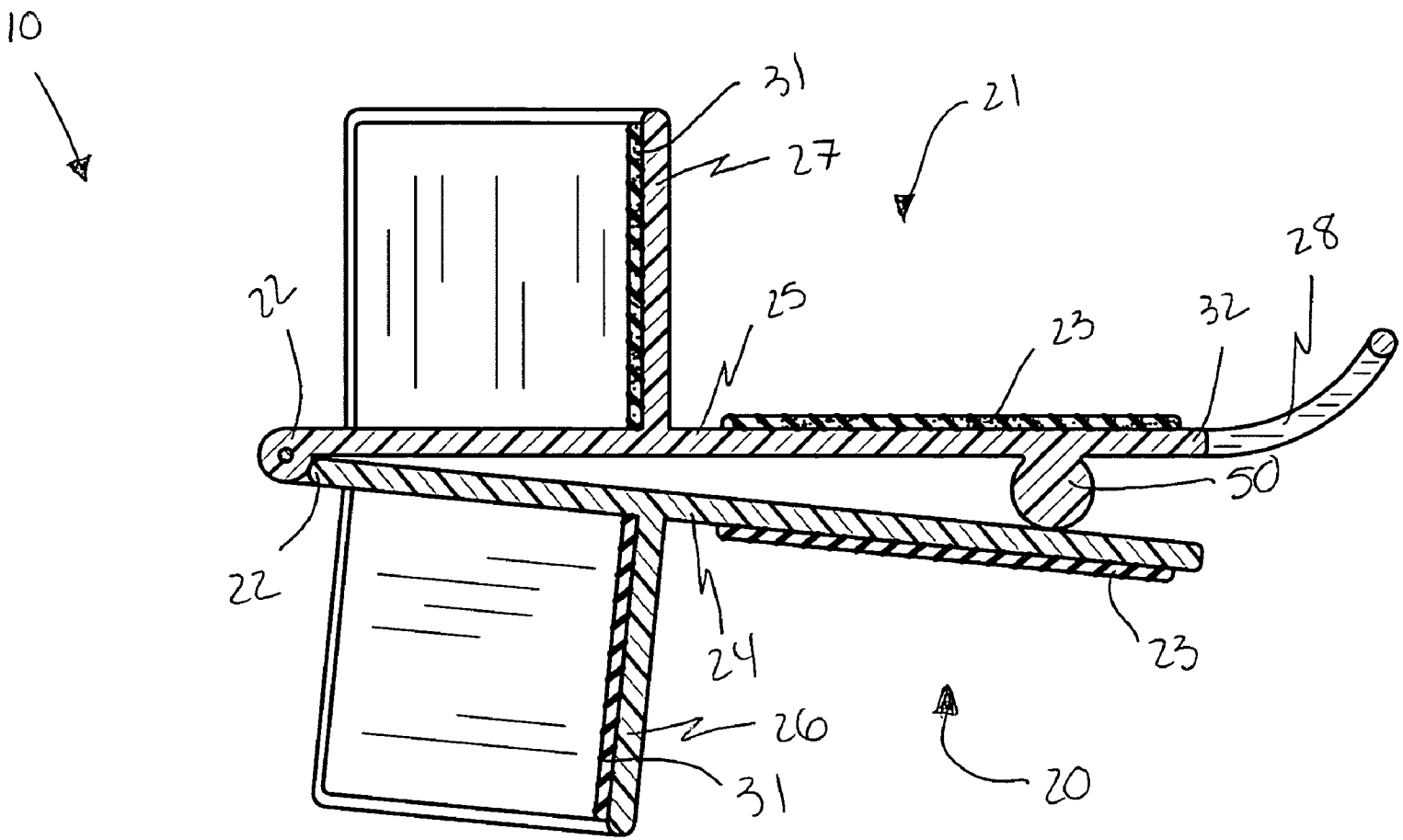
FIG. 5 is a cross sectional view, taken along line 5-5, as seen in FIG. 4.

The apparatus of this invention is referred to generally in FIGS. 1-5 by the reference numeral 10 and is intended to protect a bucket holding apparatus. It should be understood that the apparatus 10 may be used to hold many different types of bucket apparatuses and should not be limited in holding only those types of buckets mentioned herein.

Referring initially to FIGS. 1, 2, 3, 4 and 5, a bucket holding apparatus 10 includes first and second carriages 20, 21 with pivotally attached inner edges 22 arranged in such a manner that the first and second carriages 20, 21 freely rotate upwardly from a horizontal plane defined on a support surface. Each of such first and second carriages 20, 21 articulates about a shared fulcrum axis confronting the inner edges 22, and each of the first and second carriages 20, 21 include a rubber mat 23 directly conjoined, without the use of intervening elements, to respective top surfaces 24, 25 thereof. Such rubber mats 23 cover a major surface area of the first and second carriage top surfaces 24, 25 and terminate laterally from the first and second walls 26, 27 respectively. The rubber mats 23 provide a user a slip-free surface area to stand on during use, thereby preventing movement of the apparatus 10 during mixing procedures.

The first carriage 20 pivots along a counter clockwise path and the second carriage 21 pivots along a clockwise path when the lever 28 is biased towards the support surface. The first carriage 20 is pivotal along a 180 degree arcuate path while the second carriage 21 remains statically positioned on the support surface such that respective bottom surfaces of the first and second carriages 20, 21 lay coplanar and directly abut each other, without the use of intervening elements. The pivotal ability of the carriages 20, 21 allows the carriages 20, 21 to be folded together for easy portability of the apparatus 10.

Referring again to FIGS. 1, 2, 3, 4 and 5, the bucket holding apparatus 10 further includes first and second arcuate walls 26, 27 directly conjoined, without the use of intervening elements, to the first and second carriages 20, 21 and oppositely situated from the inner edges 22 which is essential such that the first and second arcuate walls 26, 27 define a circular cavity 29 within a combined perimeter thereof. Each of such walls 26, 27 include a rubber mat 30 directly conjoined, without the use of intervening elements, to an inner surface 31 thereof and travel along a major surface area of the inner surfaces 31 for providing a frictional surface against which the bucket is engaged. The first wall 26 is vertically aligned beneath the second wall 27 when the first and second carriages 20, 21 are coplanar. The first and second walls 26, 27 form a circular cavity 29 perfectly sized for securely supporting a bucket during mixing procedures.

Referring again to FIGS. 1, 2, 3, 4 and 5, the bucket holding apparatus 10 further includes an arcuate lever 28 directly and statically conjoined, without the use of intervening elements, to the second carriage 21 and extending laterally upwards away from an outer edge thereof 32. The first and second carriages 20, 21 are pivoted about the fulcrum axis when the lever 28 is biased downwardly towards the support surface which is vital such that the first and second walls 26, 27 extend apart from a horizontal equilibrium position and thereby increase a diameter of the cavity 29 for receiving the bucket therein. The lever 28 further includes a bulbous stopper 50 that prevents the first and second carriages 20, 21 from directly touching when the lever is biased downward for easy transportation. The lever 28 serves as a handle for simply and easily transporting the bucket holding apparatus 10 from one location to another.

The present invention, as claimed, provides the unexpected and unpredictable benefit of providing a portable bucket holding apparatus that folds for easy transportability and storage. The arcuate lever 28 provides the unexpected benefit of serving as a mechanism for easily facilitating the opening and closing of the carriages 20, 21 and also serves as a handle for carrying and transporting the apparatus 10. In addition, the rubber mats 23 serve as a non-slip surface for a user to stand on, thereby preventing movement of the apparatus 10 during mixing procedures. Such benefits overcome the above noted shortcomings.

In use, a method for holding a bucket at a stationary position during operating procedures includes the steps of: pivotally attaching inner edges 22 of first and second carriages 20, 21 together such that the first and second carriages 20, 21 freely rotate upwardly from a horizontal plane defined on a support surface when each of the first and second carriages 20, 21 are articulated about a shared fulcrum axis confronting the inner edges 22; conjoining first and second arcuate walls 26, 27 directly conjoined, without the use of intervening elements, to the first and second carriages 20, 21 by oppositely situating the first and second arcuate walls 26, 27 from the inner edges 22 such that the first and second arcuate walls 26, 27 define a circular cavity 29 within a combined perimeter thereof; providing an arcuate lever 28 directly and statically conjoined to the second carriage 21 and extending laterally upwards away from an outer edge thereof; and pivoting the first and second carriages 20, 21 about the fulcrum axis by biasing the lever 28 is biased downwardly towards the support surface such that the first and second walls 26, 27 extend apart from a horizontal equilibrium position and thereby increase a diameter of the cavity 29 for receiving the bucket therein.

In use, the method further includes the steps of: directly conjoining, without the use of intervening elements, a rubber mat 23 to respective top surfaces 24, 25 of each of the first and second carriages 20, 21 such that the rubber mats 23 cover a major surface area of the first and second carriage top surfaces 24, 25 and terminate laterally from the first and second walls 26, 27 respectively; pivoting the first carriage 20 along a counter clockwise path; and simultaneously pivoting the second carriage 21 along clockwise path by biasing the lever 28 towards the support surface.

In use, the method further including the steps of: directly conjoining, without the use of intervening elements, a rubber mat 31 to an inner surface of each of the walls 26, 27 such that the rubber mats 31 travel along a major surface area of the inner surfaces for providing a frictional surface against which the bucket is engaged; pivoting the first carriage 20 along a 180 degree arcuate path while the second carriage 21 remains statically positioned on the support surface such that respective bottom surfaces of the first and second carriages lay coplanar and directly abut each other; and vertically aligning the first wall 26 beneath the second wall 27 by adapting the first and second carriages 20, 21 to a coplanar position.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An apparatus for holding a bucket at a stationary position during operating procedures, said apparatus comprising:

first and second carriages having pivotally attached inner edges arranged in such a manner that said first and second carriages freely rotate upwardly from a horizontal plane defined on a support surface, each of said first and second carriages articulating about a shared fulcrum axis confronting said inner edges;

first and second arcuate walls directly conjoined to said first and second carriages and oppositely situated from said inner edges such that said first and second arcuate walls define a circular cavity within a combined perimeter thereof; and an arcuate lever directly and statically conjoined to said second carriage and extending laterally upwards away from an outer edge thereof;

wherein said first and second carriages are pivoted about the fulcrum axis when said lever is biased downwardly towards the support surface such that said first and second walls extend apart from a horizontal equilibrium position and thereby increase a diameter of the cavity for receiving the bucket therein.

2. The apparatus of claim 1, wherein each of said first and second carriages comprise: a rubber mat directly conjoined to respective top surfaces thereof, said rubber mats covering a major surface area of said first and second carriage top surfaces and terminating laterally from said first and second walls respectively.

3. The apparatus of claim 1, wherein said first carriage pivots along a counter clockwise path and said second carriage pivots along clockwise path when said lever is biased towards the support surface.

4. The apparatus of claim 1, wherein each of said walls comprise: a rubber mat directly conjoined to an inner surface thereof and travel along a major surface area of said inner surfaces for providing a frictional surface against which the bucket is engaged.

5. The apparatus of claim 1, wherein said first carriage is pivotal along a 180 degree arcuate path while said second carriage remains statically positioned on the support surface such that respective bottom surfaces of said first and second carriages lay coplanar and directly abut each other.

6. The apparatus of claim 5, wherein said first wall is vertically aligned beneath said second wall when said first and second carriages are coplanar.

7. An apparatus for holding a bucket at a stationary position during operating procedures, said apparatus comprising:

first and second carriages having pivotally attached inner edges arranged in such a manner that said first and second carriages freely rotate upwardly from a horizontal plane defined on a support surface, each of said first and second carriages articulating about a shared fulcrum axis confronting said inner edges;

first and second arcuate walls directly conjoined to said first and second carriages and oppositely situated from said inner edges such that said first and second arcuate walls define a circular cavity within a combined perimeter thereof; and an arcuate lever directly and statically conjoined to said second carriage and extending laterally upwards away from an outer edge thereof;

wherein said first and second carriages are pivoted about the fulcrum axis when said lever is biased downwardly towards the support surface such that said first and second walls extend apart from a horizontal equilibrium position and thereby increase a diameter of the cavity for receiving the bucket therein.

8. The apparatus of claim 7, wherein each of said first and second carriages comprise: a rubber mat directly conjoined to respective top surfaces thereof, said rubber mats covering a major surface area of said first and second carriage top surfaces and terminating laterally from said first and second walls respectively.

9. The apparatus of claim 7, wherein said first carriage pivots along a counter clockwise path and said second carriage pivots along clockwise path when said lever is biased towards the support surface.

10. The apparatus of claim 7, wherein each of said walls comprise: a rubber mat directly conjoined to an inner surface thereof and travel along a major surface area of said inner surfaces for providing a frictional surface against which the bucket is engaged.

11. The apparatus of claim 7, wherein said first carriage is pivotal along a 180 degree arcuate path while said second carriage remains statically positioned on the support surface such that respective bottom surfaces of said first and second carriages lay coplanar and directly abut each other.

12. The apparatus of claim 11, wherein said first wall is vertically aligned beneath said second wall when said first and second carriages are coplanar.

13. A method for holding a bucket at a stationary position during operating procedures, said method comprising the steps of:

a. pivotally attaching inner edges of first and second carriages together such that said first and second carriages freely rotate upwardly from a horizontal plane defined on a support surface when each of said first and second carriages are articulated about a shared fulcrum axis confronting said inner edges;

b. conjoining first and second arcuate walls directly conjoined to said first and second carriages by oppositely situating said first and second arcuate walls from said inner edges such that said first and second arcuate walls define a circular cavity within a combined perimeter thereof;

c. providing an arcuate lever directly and statically conjoined to said second carriage and extending laterally upwards away from an outer edge thereof; and d. pivoting said first and second carriages about the fulcrum axis by biasing said lever is biased downwardly towards the support surface such that said first and second walls extend apart from a horizontal equilibrium position and thereby increase a diameter of the cavity for receiving the bucket therein.

14. The method of claim 13, further comprising the step of:

e. directly conjoining a rubber mater to respective top surfaces of each of said first and second carriages such that said rubber mats cover a major surface area of said first and second carriage top surfaces and terminate laterally from said first and second walls respectively.

15. The method of claim 13, wherein step d. comprises the steps of:

pivoting said first carriage along a counter clockwise path; and simultaneously pivoting said second carriage along clockwise path by biasing said lever towards the support surface.

16. The method of claim 14, further comprising the step of:

directly conjoining a rubber mat to an inner surface of each of said walls such that said rubber mats travel along a major surface area of said inner surfaces for providing a frictional surface against which the bucket is engaged.

17. The method of claim 13, wherein step d. comprises the step of:

pivoting said first carriage along a 180 degree arcuate path while said second carriage remains statically positioned on the support surface such that respective bottom surfaces of said first and second carriages lay coplanar and directly abut each other.

18. The method of claim 14, further comprising the step of:

f. vertically aligning said first wall beneath said second wall by adapting said first and second carriages to a coplanar position.

* * * * *